US006927658B2

(12) United States Patent
Okamoto

(10) Patent No.: US 6,927,658 B2
(45) Date of Patent: Aug. 9, 2005

(54) DRUM TYPE CORE WITH DISCRETE STRUCTURE

(75) Inventor: Toshinori Okamoto, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 10/314,260

(22) Filed: Dec. 9, 2002

(65) Prior Publication Data

US 2003/0116671 A1 Jun. 26, 2003

(30) Foreign Application Priority Data

Dec. 21, 2001 (JP) ..... 2001-389282

(51) Int. Cl.[7] ..... H01F 27/06

(52) U.S. Cl. ..... 336/65; 336/96; 336/192; 336/198; 439/78

(58) Field of Search ..... 336/65, 83, 96, 336/192, 198, 212, 233; 439/78, 62, 555, 567

(56) References Cited

U.S. PATENT DOCUMENTS 4,498,067 A * 2/1985 Kumokawa et al. ..... 336/65
5,673,013 A * 9/1997 Moody et al. ..... 336/192
6,336,818 B1 * 1/2002 Bayer ..... 439/78

* cited by examiner

*Primary Examiner*—Lincoln Donovan
*Assistant Examiner*—Jennifer A. Poker
(74) *Attorney, Agent, or Firm*—Oliff & Berridge, PLC

(57) ABSTRACT

A drum type core comprises: a flanged cylinder including a cylinder portion with a coil wound thereon, and a flange portion connected integrally with one end of the cylinder portion; and a flange piece having on its one side an engaging hole, into which the other end of the cylinder portion of the flanged cylinder is inserted. The flanged cylinder and the flange piece are made of respective different materials. The flanged cylinder has a higher permeability and saturation flux density than the flange piece, while the flange piece has a higher surface electrical resistance than the flanged cylinder. The flanged cylinder is entirely coated with a heat-resisting epoxy resin except an outer side of the flange portion. The flange piece is provided with terminal pins, around which lead wires of the coil passing by the circumference of the flange piece are bound.

4 Claims, 6 Drawing Sheets

DRUM TYPE CORE WITH DISCRETE STRUCTURE

BACKGROUND OF THE INVENTION

1. Field of the Invention

The present invention relates to a drum type core for use in a high frequency coil, and the like, more particularly to a drum type core that, without using a bobbin at its winding portion, enhances insulation performance and protects coil wires.

2. Description of the Related Art

A ferrite drum type core, which comprises: a central cylinder portion having a small diameter and having a coil provided therearound; and two flange portions having a large diameter and provided at respective ends of the cylinder, has been universally known and is widely used in high frequency transformers, high frequency coils, and the like. The conventional drum type core is structured usually such that the central cylinder portion is integrated with the flange portions formed as a single piece.

The drum type core thus structured can not be completed by press molding alone but is produced such that at first, a ferrite is molded into a cylinder, then the central portion of the cylinder is circumferentially machined by centerless grinding. Due to the configurational constraint of a grinding wheel employed, the flange portions have right-angled inside edges.

Wire terminals of the coil provided around the cylinder portion are usually bound around and soldered to terminal pins attached to a core or a base. In the conventional drum type core, it can happen that the wire terminals touch the edges at the inside faces of the flange portions and have their insulation coating damaged or peeled off.

Especially when a Mn—Zn ferrite is used as a core material, a slightest damage on the wire can lead to a short-circuit problem due to the material having a very low surface electrical resistance. The Mn—Zn ferrite has distinctive electrical characteristics that can not be obtained with a Ni—Zn ferrite conventionally used in a high frequency range, but has the above described critical drawback of poor insulation performance.

To improve the insulation performance, the core is coated with varnish, but the edges of the flange portions are hard to be sufficiently covered, which makes the insulation imperfect, resulting in failure to prevent the short-circuit from happening. To overcome the problem of the conventional art, a drum type core, which is made of a material with a low surface electrical resistance such as a Mn—Zn ferrite and is still free from the above described wire insulation failure, is disclosed in Japanese Utility Model Patent No. Hei 6-35445.

The drum type core disclosed therein is advantageous especially when the core is made of a material with a low surface electrical resistance, such a Mn—Zn ferrite. In the drum type core, a coil is provided on a resin bobbin, and wire terminals of the coil are taken out along a cranked extension from the flange portion of the core and usually are bound around and soldered to terminal pins disposed outside.

FIGS. 9 and 10 are respectively an exploded perspective view and a cross-sectional view of an embodiment of the above described conventional drum type core. Referring to FIG. 9, the drum type core comprises: a single-flanged cylinder 114 composed of a cylinder portion 110 and a flange portion 112 formed integrally with the cylinder portion 110; and a counterpart flange piece 118, into whose central hole a plain end of the flanged cylinder 114 is to be inserted. A resin bobbin 116 configured uniquely is provided around the cylinder portion 110.

The flanged cylinder 114 and the counterpart flange piece 118 are sintered compacts made of, for example, a Mn—Zn ferrite. Unlike conventionally, these two components are produced separately and so can be completed easily by press molding, thereby eliminating the process of centerless grinding The resin bobbin 116 is molded of a synthetic resin as a single piece with a very small wall thickness, and includes two flanges 116*a*, 116*a* which have an outer diameter equal to or slightly larger than that of the flange portion 112 or the counterpart flange piece 118. The bobbin 116 includes further two flange extensions 116*b*, 116*b* configured annular and extending outward respectively from and perpendicular to the bobbin flanges 116*a*, 116*a* so as to cover respective inside edges of the flange portion 114 and the counterpart flange piece 118.

Referring to FIG. 10, the bobbin 116 is provided with a coil 120 wound thereon, is then fitted onto the cylinder portion 110, and the counterpart flange piece 118 is attached to the plain end of the cylinder portion 110 and fixed using adhesive or the like, thus completing the drum type core.

In the above described drum type core, the wire terminals of the coil are protected by the bobbin thereby preventing insulation failure even when the core, is made of a material with a low surface electrical resistance such as a Mn—Zn ferrite. The drum type core, however, requires a bobbin, which pushes up the product cost, and also reduces the coil space, namely space factor, rendering the above described art unsuitable, especially for a small size drum type core.

SUMMARY OF THE INVENTION

The present invention has been made in view of the disadvantage, and it is an object of the present invention to provide a drum type core which has a small dimension but still can be used with a high voltage.

In order to achieve the above object, according to a first aspect of the present invention, the drum type core comprises: a single-flanged cylinder (hereinafter referred to as "flanged cylinder"), which is structured such that a cylinder portion has a flange portion integrally connected with its one end and has nothing on the other end, and such that a coil is wound around the cylinder portion; and a counterpart flange piece (hereinafter referred to as "flange piece"), which is prepared separately from the flanged cylinder, is formed of a material different from that of the flanged cylinder, and which has on its inner side an engaging hole for receiving the other end of the cylinder portion of the flanged cylinder inserted thereinto.

According to a second aspect of the present invention, in the drum type core of the first aspect, the flanged cylinder has a higher permeability and saturation flux density than the flange piece, while the counterpart flange has a higher surface electrical resistance than the flanged cylinder.

According to a third aspect of the present invention, in the drum type core of the first or second aspect, the flanged cylinder is formed of a Mn—Zn ferrite, and the flange piece is formed of either a Ni—Zn ferrite or a Mg—Zn ferrite.

According to a fourth aspect of the present invention, in the drum type core of the first aspect, the flanged cylinder is entirely coated with an epoxy resin except an outer side of the flange portion.

According to a fifth aspect of the present invention, in the drum type core of the first aspect, the flange piece is provided with coil terminals.

In the present prevention, since the flanged cylinder and the flange piece are prepared separately from each other, the core can be produced only by molding process ensuring smooth inner surfaces, whereby the insulation of the lead wires of the coil are kept free from scratches. Also, since the flanged cylinder and the flange piece are made of respective different materials, wherein the flanged cylinder has a higher permeability and saturation flux density than the flange piece while the flange piece has a higher surface electrical resistance than the flanged cylinder, and since the flanged cylinder is coated entirely, except the outer side of the flange portion, with an epoxy resin, the drum type core does not require a bobbin for a coil winding, is small sized and withstands a high voltage. Further, since the flange piece is made of a material having a high surface resistance, the drum type core is free from insulation failure even if coil terminals are provided on the flange piece.

DESCRIPTION OF THE PREFERRED EMBODIMENTS

Figure 1:
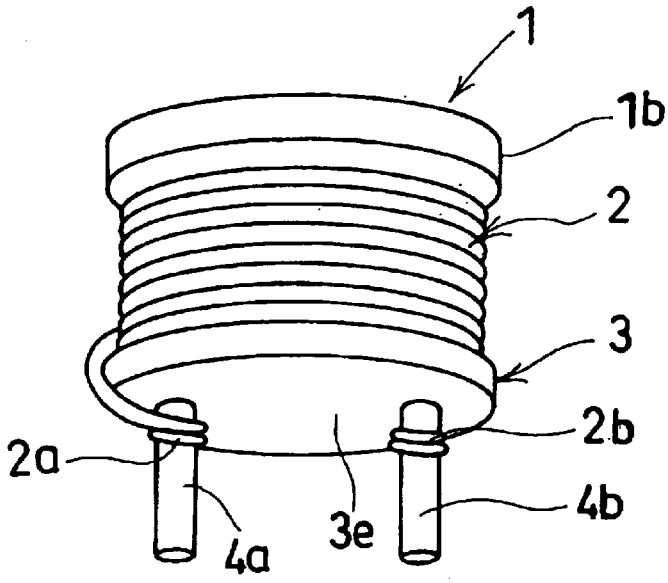
FIG. 1 is a perspective view of a drum type core including a coil according to an embodiment of the present invention.
Figure 2:
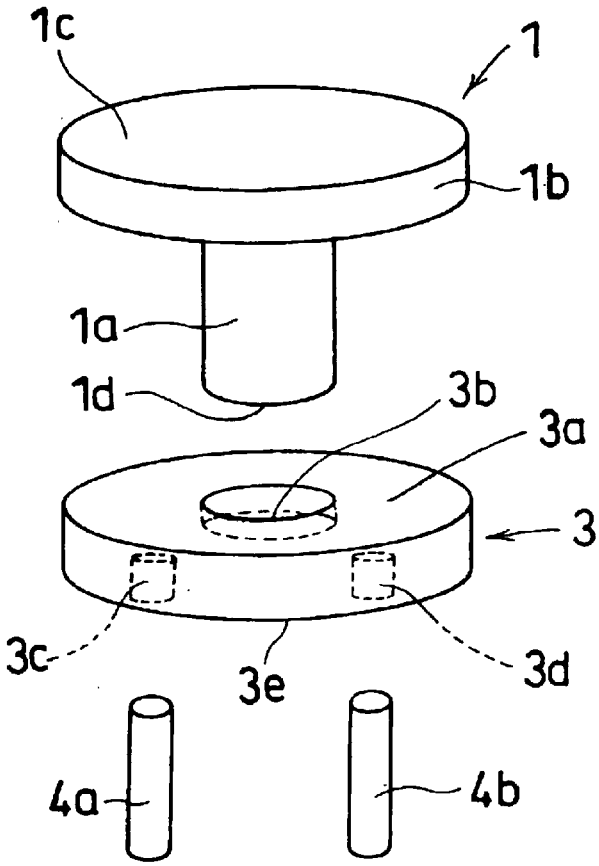
FIG. 2 is an exploded perspective view of the drum type core of FIG. 1 omitting the coil.
Figure 3:
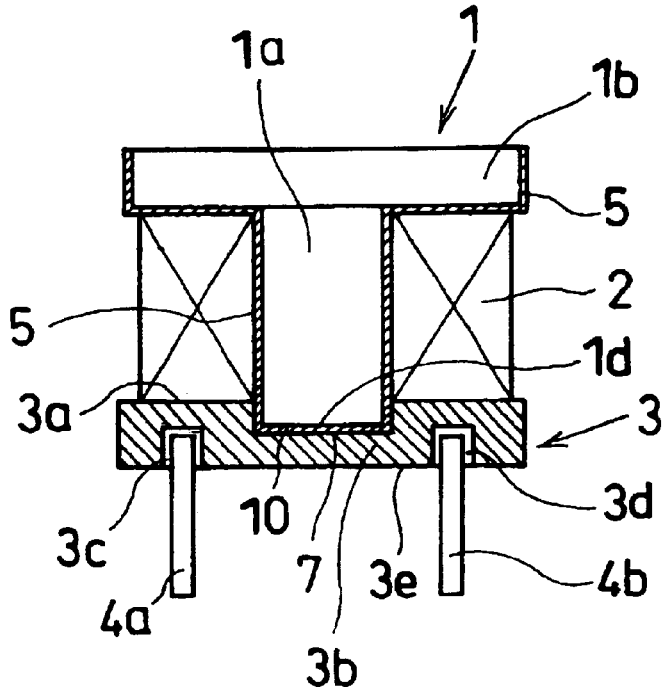
FIG. 3 is a cross-sectional view of the drum type core of FIG. 1.

An embodiment of the present invention will be described with reference to FIGS. 1 to 3. A drum type core comprises: a single-flanged cylinder (hereinafter referred to as "flanged cylinder") 1, which is structured such that a cylinder portion 1*a* has a flange portion 1*b* integrally connected to its one end as a single piece and has nothing on the other end (hereinafter referred to as "plain end") 1*d*, and such that a coil 2 is wound around the cylinder portion 1*a*; and a counterpart flange piece (hereinafter referred to as "flange piece") 3, which has on its inner side 3*a* a round cavity 3*b* fir receiving the plain end 1*d* of the cylinder portion 1*a* fitted thereinto, and which has, on its outer side 3*e* opposite to the inner side 3*a*, two blind holes 3*c*, 3*d* for receiving respectively terminal pins 4*a*, 4*b* fitted thereinto.

The flanged cylinder 1 and the flange piece 3 are made of materials different from each other, wherein the flanged cylinder 1 has a higher permeability and saturation flux density than the flange piece 3 while the flange piece 3 has a higher surface electrical resistance than the single-flanged cylinder 1. For example, the flanged cylinder 1 is made of a Mn—Zn ferrite which has a permeability of about 2,000 and a saturation flux density of about 500 mT, and the counterpart flange 3 is made of a Ni—Zn or Mg—Zn ferrite which has a permeability of 400 to 600 and a saturation flux density of 300 to 350 mT, and which has a surface electrical resistance as high as about $10^8$ Ωcm.

The flanged cylinder 1 is coated entirely, except an outer side 1*c*, with a heat-resisting epoxy resin 5 with a layer thickness of 10 to 100 μm in order to increase withstand voltage. The coating thickness is appropriately determined according to the kind of the epoxy resin, the withstand voltage, and so forth.

The coil 2 is wound on the cylinder portion 1*a* of the flanged cylinder 1, which is coated with the epoxy resin 5. The plain end 1*d* of the cylinder portion 1*a*, with the coil 2 wound thereon, is fitted into the round cavity 3*b* of the flange piece 3.

A heat-resisting epoxy resin or the like as adhesive is applied into the blind holes 3*c*, 3*d* formed on the outer side 3*e* of the flange piece 3 opposite to the inner side 3*a* provided with the round cavity 3*b*, and the terminal pins 4*a*, 4*b* are inserted in the blind holes 3*c*, 3*d*, respectively. Wire terminals 2*a*, 2*b* of the coil 2 pass by the circumference of the flange piece 3 and are bound around the terminal pins 4*a*, 4*b*, respectively.

Figure 4:
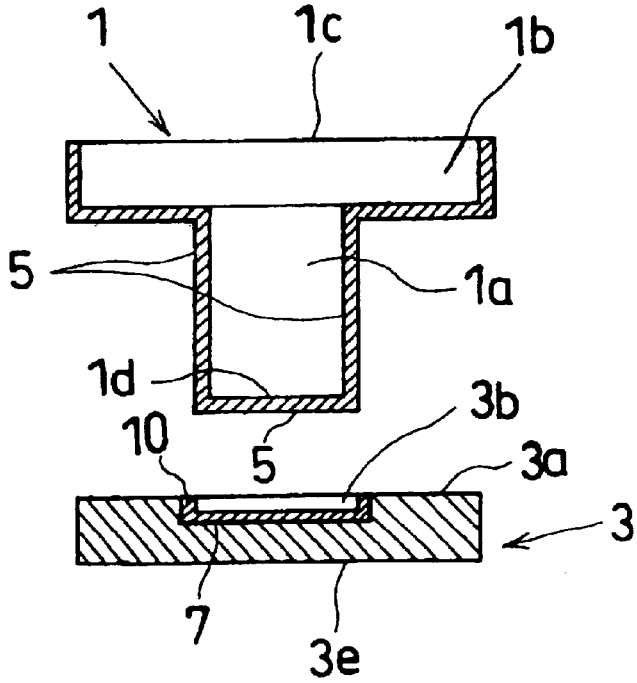
FIG. 4 is a cross-sectional view of the drum type core of FIG. 2 omitting terminal pins.

Referring to FIG. 4, a heat-resisting epoxy resin 10 as adhesive is applied on a bottom 7 and a circumferential wall of the round cavity 3*b* of the flange piece 3. The heat-resisting epoxy resin 10 may be same as the epoxy resin 5 used to increase withstand voltage.

Thus, the drum type core can withstand a high voltage even when the flanged cylinder 1 is made of a material having a low surface electrical resistance. Also, the drum type core does not require a bobbin on which a coil is wound and has an increased permeability and saturation flux density, resulting in easy downsizing and reduced cost.

The flange piece 3 has a high resistance as it is, therefore not requiring the epoxy resin 5 for increasing withstand voltage, and can be easily jointed to the flanged cylinder 1 with adhesive (the epoxy resin 10), thus simply completing the drum type core.

Figure 5:
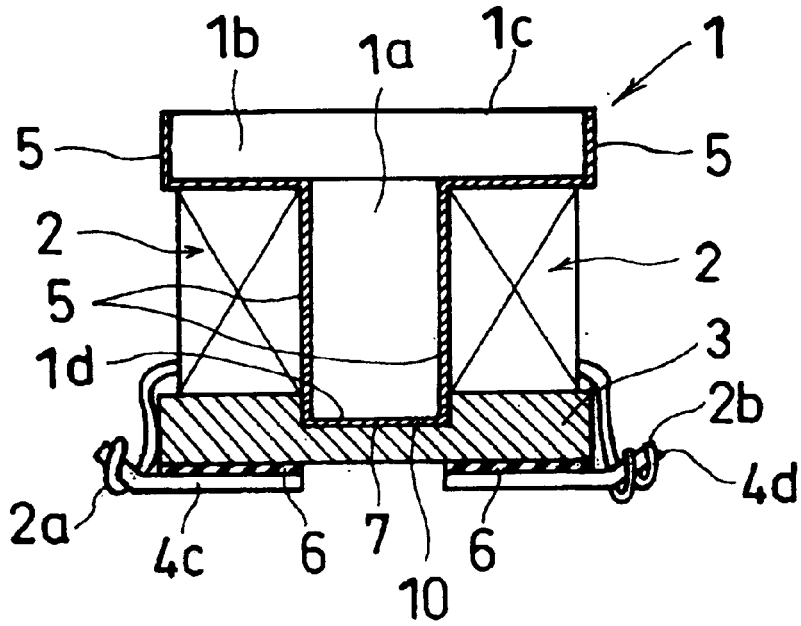
FIG. 5 is a partial cross-sectional view of a drum type core according to a second embodiment of the present invention.
Figure 6:
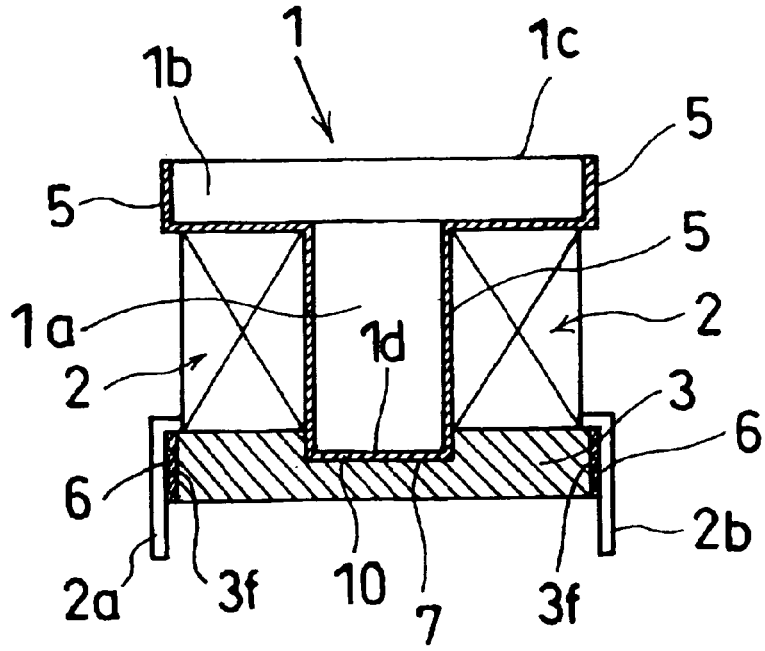
FIG. 6 is a partial cross-sectional view of a drum type core according to a third embodiment of the present invention.
Figure 7:
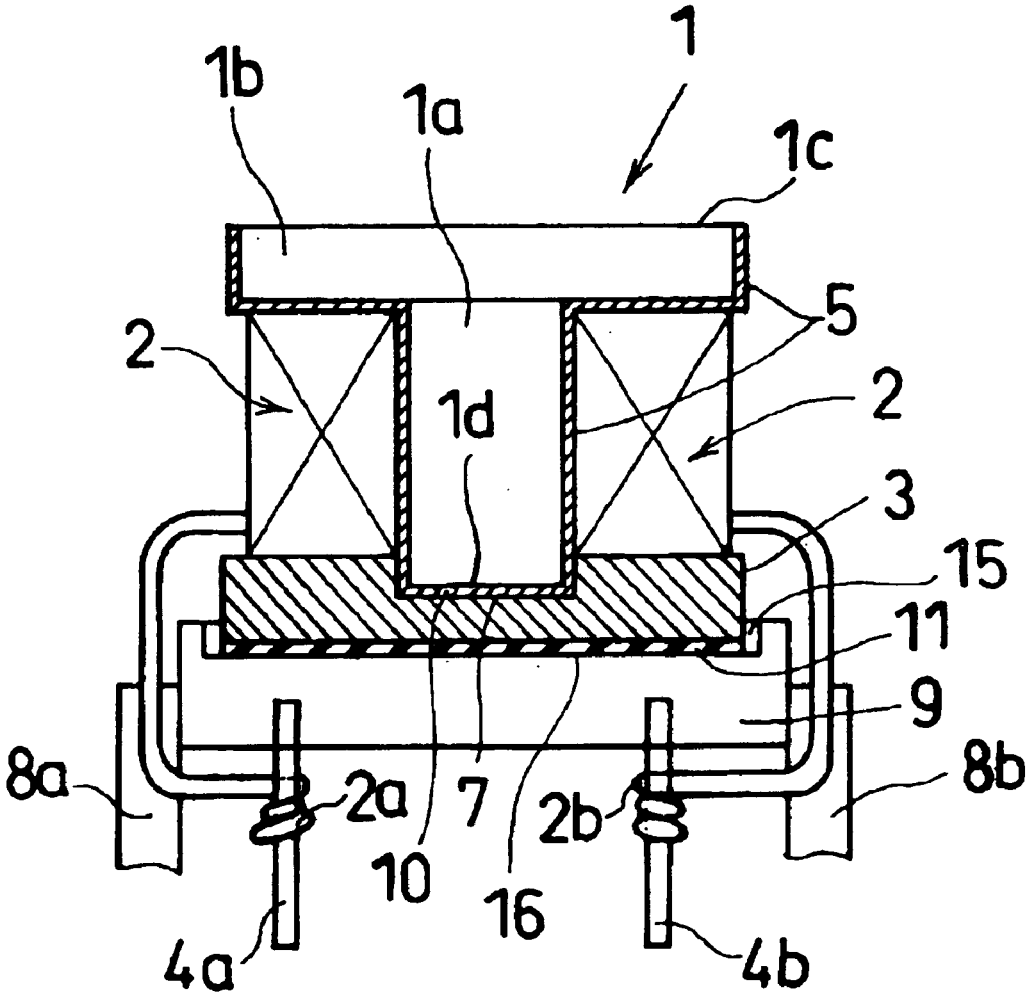
FIG. 7 is a partial cross-sectional view of a drum-type core according to a fourth embodiment of the present invention.

FIGS. 5 to 7 show further embodiments of the present invention, in which the flanged cylinder 1, the flange piece 3, the epoxy resin 5, and the epoxy resin 10 are identical with those of the first embodiment, and their explanation is omitted.

Referring to FIG. 5 showing a second embodiment, terminal plates 4*c*, 4*d* are attached on an outer side 3*e* of a flange piece 3 with an adhesive 6. Wire terminals 2*a*, 2*b* of a coil 2 pass by the circumference of the flange piece 3 and are bound around the terminal plates 4*c*, 4*d*, respectively. With this configuration, the molding die for the flange piece 3 does not involve the holes 3*c*, 3*d*, thereby reducing the mold cost, and also decreasing the height of the core to be suitable for surface mounting.

Referring to FIG. 6 showing a third embodiment, wire terminals 2*a*, 2*b* of a coil 2 are taken out immediately from a circumference 3*f* of a flange piece 3. An adhesive 6 is applied to the circumference 3*f* so as to fix the wire terminals 2*a*, 2*b*.

The above embodiments shown in FIGS. 5 and 6 are applicable when the wire of the coil 2 is thick, and eliminate the terminal pins 4*a*, 4*b*, thereby reducing the cost.

Referring to FIG. 7 showing a fourth embodiment, a base 9 is provided, which is made of, for example, a plastic material, and which is so configured as to accommodate a flange piece 3 on its top. The base 9 has four legs (only two 8*a*, 8*b* of the four are illustrated) on its circumference, is fixed to a substrate (not shown) via the four legs, has a recess 15 formed on its top, and is provided with terminal pins 4*a*, 4*b* on its bottom. In this configuration, the coil 2, which normally has to be wound on the drum type core only after the flanged cylinder 1 is jointed to the flange piece 3, may be pre-wound on the core before the flanged cylinder 1 is jointed to the flange piece 3, which enables optimization of the processes, thereby increasing production efficiency. The wire terminals 2*a*, 2*b* pass by the circumferences of the flange piece 3 and the base 9, and are bound around and soldered to the terminal pins 4*a*, 4*b*, respectively. As a result, the core is separated from the soldered portions by the base 9 disposed therebetween, and therefore is prevented from suffering a direct thermal shock from soldering. This puts the drum type core of the present invention in an advantageous position, especially when the core is large sized. Thus, in the drum type core of the present invention, the flange piece is formed of a material having a high surface electrical resistance, and accordingly there is no possibility of insulation failure even if coil terminals are provided on the flange piece.

Figure 8:
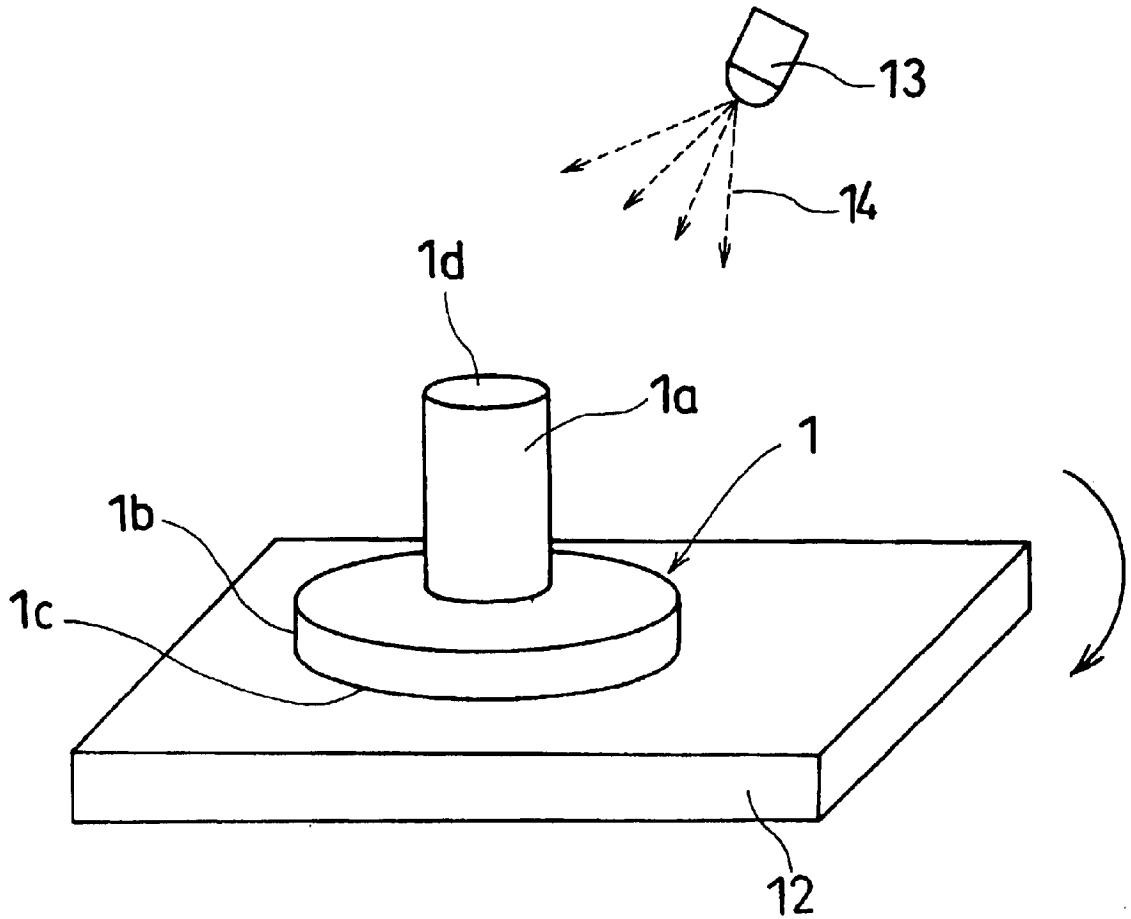
FIG. 8 is an explanatory view showing how a single-flanged cylinder is produced.
Figure 9:
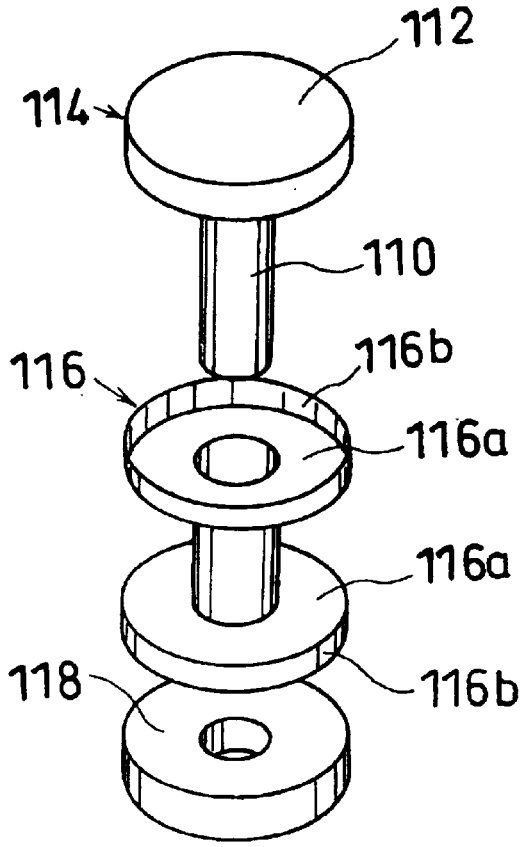
FIG. 9 (RELATED ART)
FIG. 9 is an exploded perspective view of a conventional drum type core omitting a coil.
Figure 10:
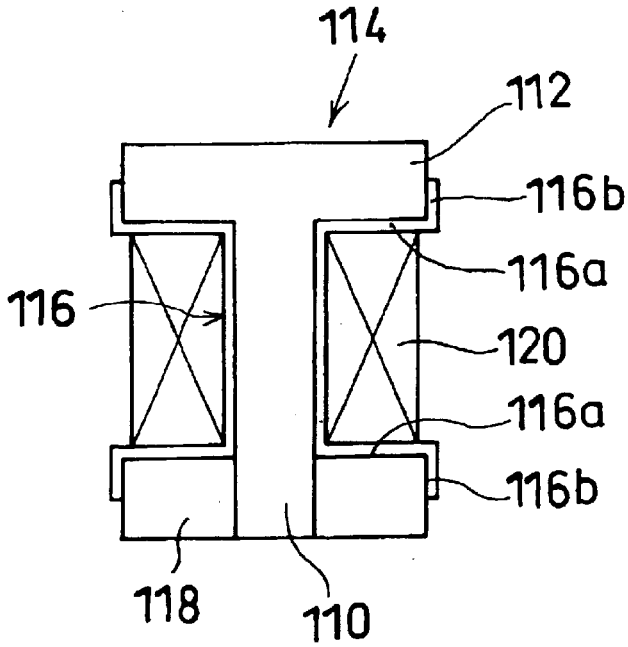
FIG. 10 (RELATED ART)
FIG. 10 is a cross-sectional view of the conventional drum type core including a coil.

Production of the flanged cylinder 1 will be described with reference to FIG. 8. The flanged cylinder 1 is placed, with the outer side 1*c* of the flange portion 1*b* downward, on a work table 12 which rotates at a constant speed. A sprayer 13 for spraying a dilute solution 14 onto the flanged cylinder 1 to form the heat-resisting epoxy resin 5 for increasing withstand voltage is disposed above the flanged cylinder 1. The dilute solution 4 prepared by appropriately diluting the epoxy resin 5 is sprayed onto the single-flanged cylinder 1 from thereabove, and the spraying operation stops when the layer of the dilute solution 14 reaches a thickness of 10 to 100 $\mu$m. The spraying time is determined depending on the kind of the epoxy resin 5, the dilution ratio, the withstand voltage, or the like. After the epoxy resin 5 is cured, the flanged cylinder 1 is taken off from the work table 12. The work table 12 may move linearly in a horizontal direction, rather than rotating, in which case the sprayer 13 is appropriately disposed so that the dilute solution 14 sprayed therefrom can be sprayed evenly all over the flanged cylinder 1.

What is claimed is:

1. A drum type core comprising:

a single-flanged cylinder structured such that a cylinder portion has a flange portion integrally connected with its one end and has nothing on the other end, and such that a coil is wound around the cylinder portion; and a counterpart flange piece prepared separately from the single-flanged cylinder, and having on its inner side an engaging hole into which the other end of the cylinder portion of the single-flanged cylinder is inserted and concurrently having on its outer side blind holes into which terminal pins are inserted, the counterpart flange piece being formed of a material different from that of the single-flanged cylinder, wherein the single-flanged cylinder has a higher permeability and saturation flux density than the counterpart flange piece, while the counterpart flange piece has a higher surface electrical resistance than the single-flanged cylinder, and the terminal pins are directly provided on the blind holes of the counterpart flange piece with no intermediate member.

2. A drum type core according to claim 1, wherein the single-flanged cylinder is formed of a Mn—Zn ferrite and the counterpart flange piece is formed of one of a Ni—Zn ferrite and a Mg—Zn ferrite.

3. A drum type core according to claim 1, wherein the single-flanged cylinder is entirely coated with an epoxy resin except an outer side of the flange portion.

4. A drum type core according to claim 1, wherein the counterpart flange piece is provided with coil terminals.

* * * * *